US007793803B2

(12) United States Patent
Neerincx et al.

(10) Patent No.: US 7,793,803 B2
(45) Date of Patent: Sep. 14, 2010

(54) BELLOWS PUMP SYSTEM AND METHOD FOR THE USE THEREOF

(75) Inventors: Peter Eduard Neerincx, Oisterwijk (NL); Jeroen Daniël de Regt, Oss (NL)

(73) Assignee: Meadwestvaco Calmar Netherlands B.V., Albert Eisteinweg (NL)

( * ) Notice: Subject to any disclaimer, the term of this patent is extended or adjusted under 35 U.S.C. 154(b) by 1049 days.

(21) Appl. No.: 10/518,205

(22) PCT Filed: Jul. 3, 2003

(86) PCT No.: PCT/NL03/00493

§ 371 (c)(1),
(2), (4) Date: Aug. 4, 2005

(87) PCT Pub. No.: WO2004/004921

PCT Pub. Date: Jan. 15, 2004

(65) Prior Publication Data

US 2006/0163286 A1 Jul. 27, 2006

(30) Foreign Application Priority Data

Jul. 3, 2002 (NL) ..... 1020983
Jun. 16, 2003 (NL) ..... 1023670

(51) Int. Cl.
*B05B 11/06* (2006.01)

(52) U.S. Cl. ..... 222/207; 92/34; 417/472

(58) Field of Classification Search ..... 222/633, 222/202, 203, 209, 207, 213, 321.1, 321.7, 222/336, 339–341; 417/472, 454; 92/34
See application file for complete search history.

(56) References Cited

U.S. PATENT DOCUMENTS 3,749,290 A * 7/1973 Micallef ..... 222/207
4,220,264 A * 9/1980 Gamadia ..... 222/207
4,347,953 A 9/1982 Bauer
4,394,939 A * 7/1983 Thor et al. ..... 222/207
4,771,925 A * 9/1988 Stoffler et al. ..... 222/207
4,809,887 A * 3/1989 Jupin et al. ..... 222/207
4,892,231 A * 1/1990 Ball ..... 222/207

(Continued)

FOREIGN PATENT DOCUMENTS

AU 7909787 4/1988

(Continued)

OTHER PUBLICATIONS

James Ellsworth Boyd, Strength of Materials, 1911, McGraw Hill.*

*Primary Examiner*—Kevin P Shaver
*Assistant Examiner*—Robert K Nichols, II
(74) *Attorney, Agent, or Firm*—MWV Intellectual Property Group

(57) ABSTRACT

The present invention provides an assembly of bellows part and a part against which unrolling takes place (the unrolling part), comprising a bellows part with a flexible wall of a predetermined shape and thickness variation which co-operates with an unrolling part with a stiff outer wall along which the flexible wall is movable, wherein the unrolling part has a predetermined diameter variation and/or the flexible wall has a predetermined thickness variation so as to cause a desired development of force.

20 Claims, 13 Drawing Sheets

U.S. PATENT DOCUMENTS

| | | | | | |
|---|---|---|---|---|---|
| 4,949,876 | A | * | 8/1990 | Schneider | 222/209 |
| 4,979,646 | A | | 12/1990 | Andris | |
| 5,014,881 | A | * | 5/1991 | Andris | 222/207 |
| 5,042,694 | A | * | 8/1991 | Birmelin | 222/145.3 |
| 5,205,441 | A | * | 4/1993 | Andris | 222/207 |
| 5,236,204 | A | * | 8/1993 | Hempel | 277/636 |
| 5,267,673 | A | * | 12/1993 | Crosnier et al. | 222/321.7 |
| 5,518,147 | A | * | 5/1996 | Peterson et al. | 222/153.07 |
| 5,664,703 | A | | 9/1997 | Reifenberger et al. | |
| 6,715,649 | B2 | * | 4/2004 | Santagiuliana | 222/380 |
| 7,213,726 | B2 | * | 5/2007 | Rossignol | 222/153.13 |
| 7,367,476 | B2 | * | 5/2008 | Law et al. | 222/153.06 |
| 2003/0132252 | A1 | * | 7/2003 | Rossignol | 222/207 |

FOREIGN PATENT DOCUMENTS

| | | | | |
|---|---|---|---|---|
| DE | 20019540 | U1 | | 1/2001 |
| EP | 0213048 | A1 | | 3/1987 |
| EP | 0720951 | A1 | | 7/1996 |
| EP | 1199105 | A1 | * | 4/2002 |
| GB | 2161222 | A | | 1/1986 |
| JP | 10236503 | | | 8/1998 |

* cited by examiner

BELLOWS PUMP SYSTEM AND METHOD FOR THE USE THEREOF

The present invention relates to an assembly of a bellows and a co-acting part, a pump comprising such an assembly and a method for use thereof.

A pump with a bellows is known from the U.S. Pat. No. 4,347,953. This known pump is constructed from a minimum of four parts, i.e. a housing, a cap, a bellows and a part co-acting with the bellows. Such a bellows has a spring force which, after a determined compression has been passed, is lower than the initial value, whereby the further compression is assisted. A flexible wall of the bellows moves in the free space during compression, whereby the development of force is uncontrolled. The application of this pump is limited to dispensing a predetermined amount of foam, liquid or gas.

The present invention has for its object to provide an improved bellows which is suitable for multiple applications.

The invention provides for this purpose an assembly of bellows part and co-acting part, comprising a bellows part with a flexible wall of a predetermined shape and thickness which co-operates with the co-acting part, which comprises a stiff outer wall along which the flexible wall is movable.

Such an assembly provides a simpler and less expensive solution.

In a preferred embodiment the part against which unrolling takes place (the unrolling part) has a predetermined diameter variation and/or the flexible wall has a predetermined thickness variation so as to cause a desired development of force.

Owing to the co-operation of the flexible wall with the unrolling part it is found possible to determine the development of force as desired so that, depending on the application, the spring characteristic can be predetermined.

In a preferred embodiment the flexible wall is partially turned back and wherein a turned-back edge is arranged on an outer end thereof for absorbing a pressure force. The turned-back edge provides a stable point of engagement for transmitting pressure forces in controlled manner from the unrolling part onto the bellows part and vice versa.

In a preferred embodiment the development of force is constant, increasing, decreasing or a combination thereof. Practically any desired development of force can thus be obtained.

In a preferred embodiment the development of force comprises one or more peaks. An oscillating development of force is thus achieved, for instance for an improved dispensing.

In a preferred embodiment the outer end of the unrolling part is conical. This is found to produce the desired control of the development of force.

In a preferred embodiment the outer end of the unrolling part comprises a thickened portion for the purpose of causing a peak in the development of force. The peak in the development of force indicates that a determined point has been reached and thus acts as dispensing indication, wherein both the end quantity, for instance 10 ml, and the quantity at the force peak, for instance 5 ml, apply as reference.

In a further preferred embodiment the outer end comprises a bend.

In a further preferred embodiment the outer end comprises a part of concave cross-section for the purpose of causing an increasing spring force.

In a further preferred embodiment the outer end comprises a part of convex cross-section for the purpose of causing a decreasing spring force.

Further advantages and features are discussed with reference to the annexed figures, in which:

FIGS. 1*a* and 1*b* show a cross-section of a pump with an assembly according to the invention in a first preferred embodiment, and in a first and a second position of use;

FIG. 1*c* shows the development of force of the assembly of FIG. 1*a;*

FIGS. 2*a* and 2*b* show a cross-section of a pump with an assembly according to the invention in a second preferred embodiment, and in a first and a second position of use;

FIG. 2*c* shows the development of force of the assembly of FIG. 2*a;*

FIGS. 3*a* and 3*b* show a cross-section of a pump with an assembly according to the invention in a third preferred embodiment, and in a first and a second position of use;

FIG. 3*c* shows the development of force of the assembly of FIG. 3*a;*

FIGS. 4*a* and 4*b* show a cross-section of a pump with an assembly according to the invention in a fourth preferred embodiment, and in a first and a second position of use;

FIG. 4*c* shows the development of force of the assembly of FIG. 4*a;*

Figure 6:
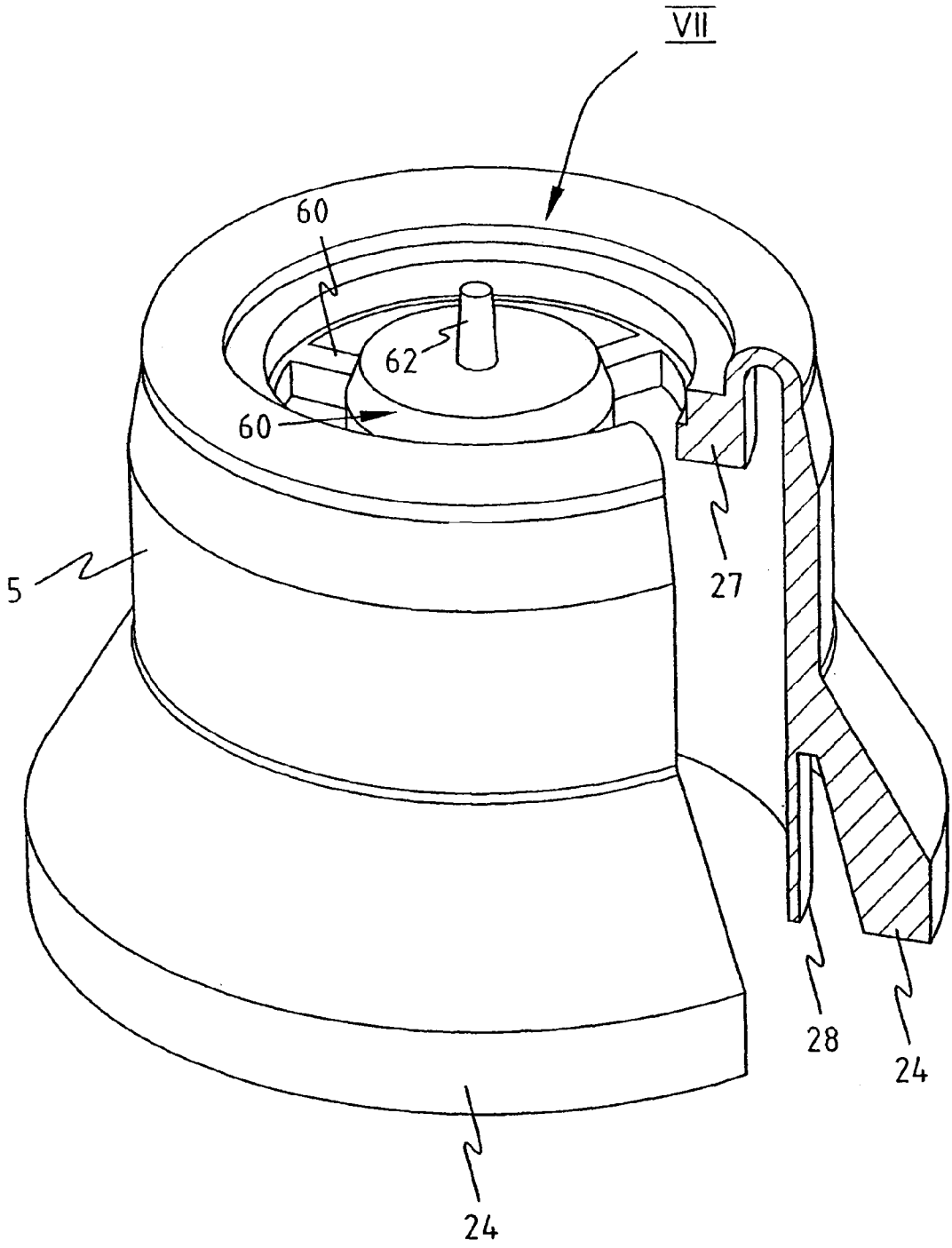
FIG. 6 shows a partly cut-away perspective view of a bellows according to the present invention in a sixth preferred embodiment.
Figure 8C:
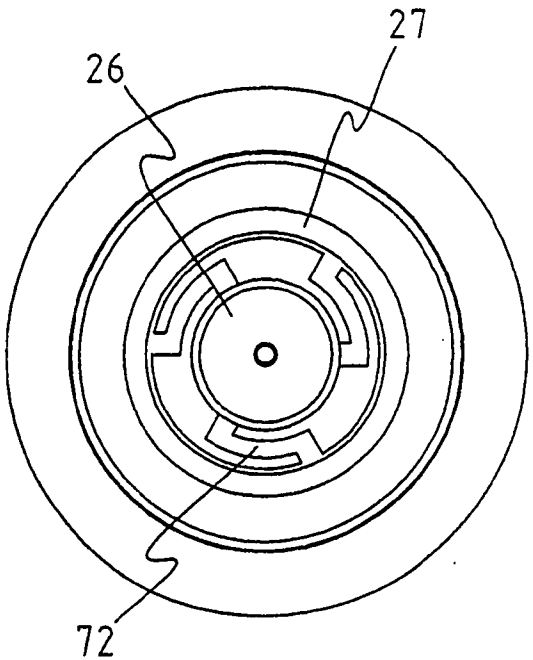
Figure 8B:
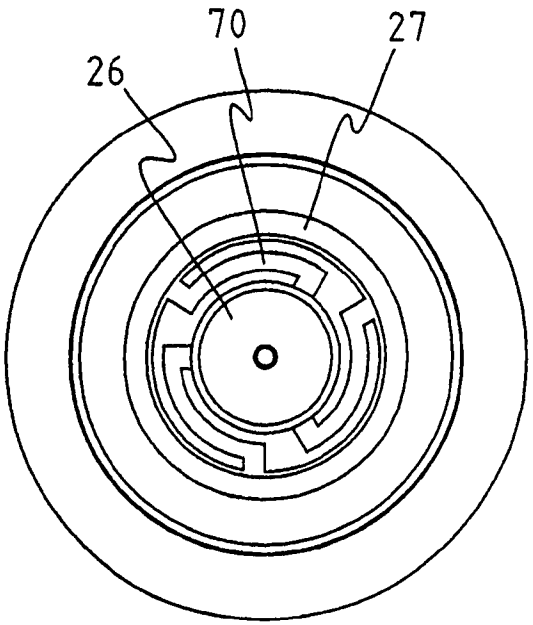
Figure 8A:
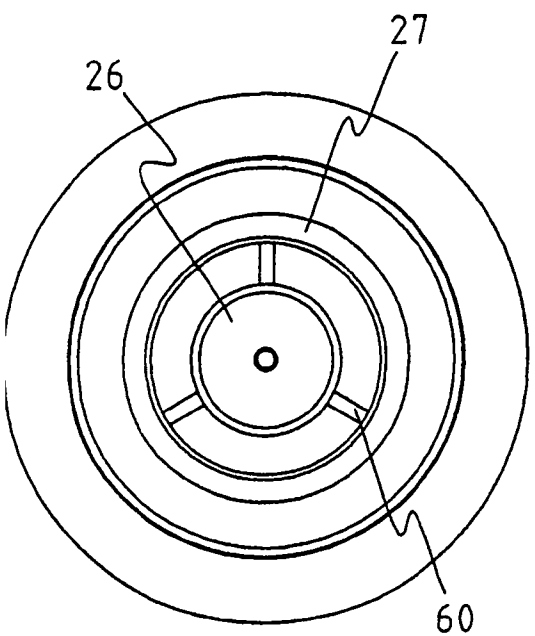
Figure 9:
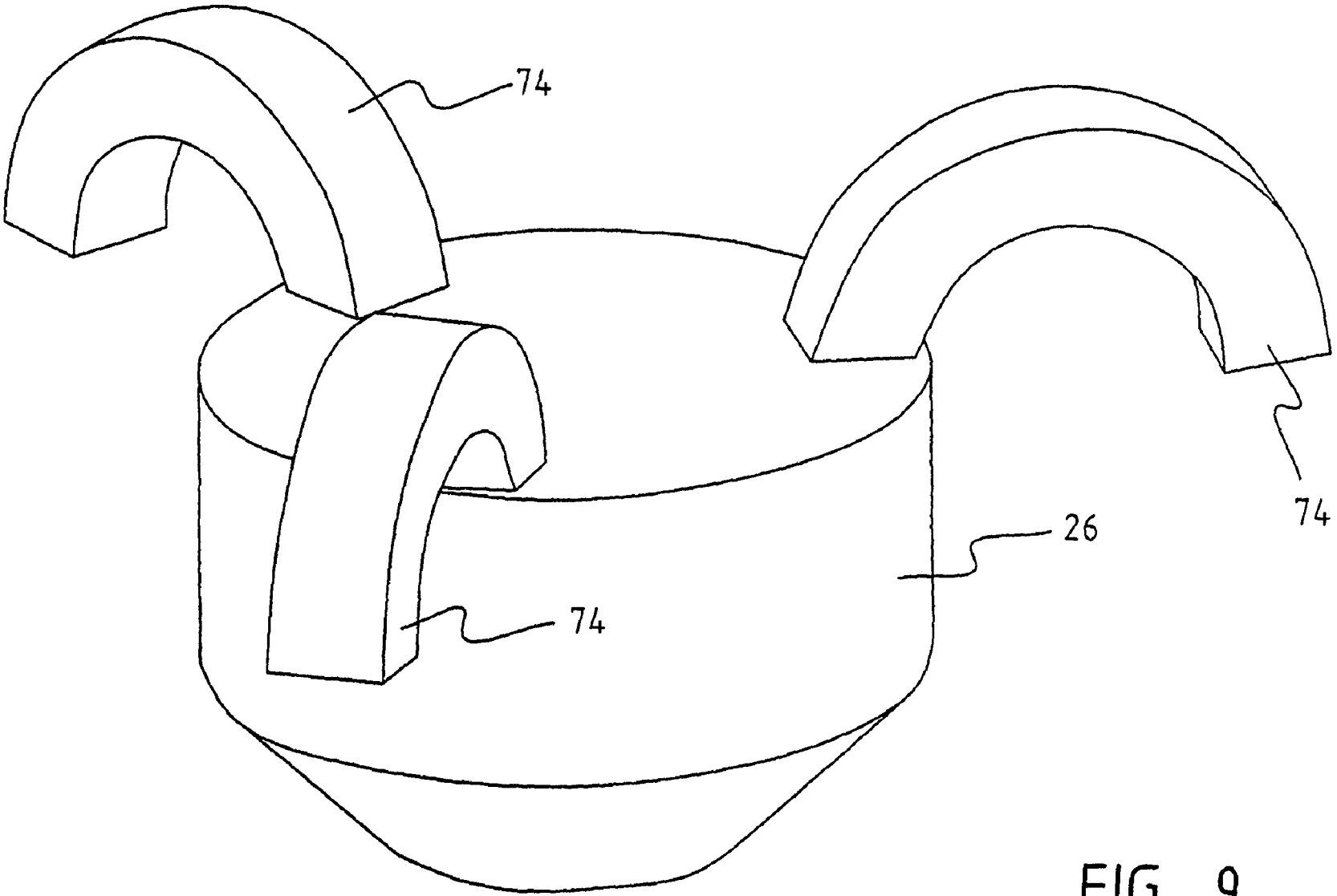

FIGS. 8*a*-8*c* are top views of the bellows of FIG. 6 provided with a suction valve in three different embodiments; and FIG. 9 is a perspective view of a suction valve in an eighth preferred embodiment.

Figures 1A, 1B:
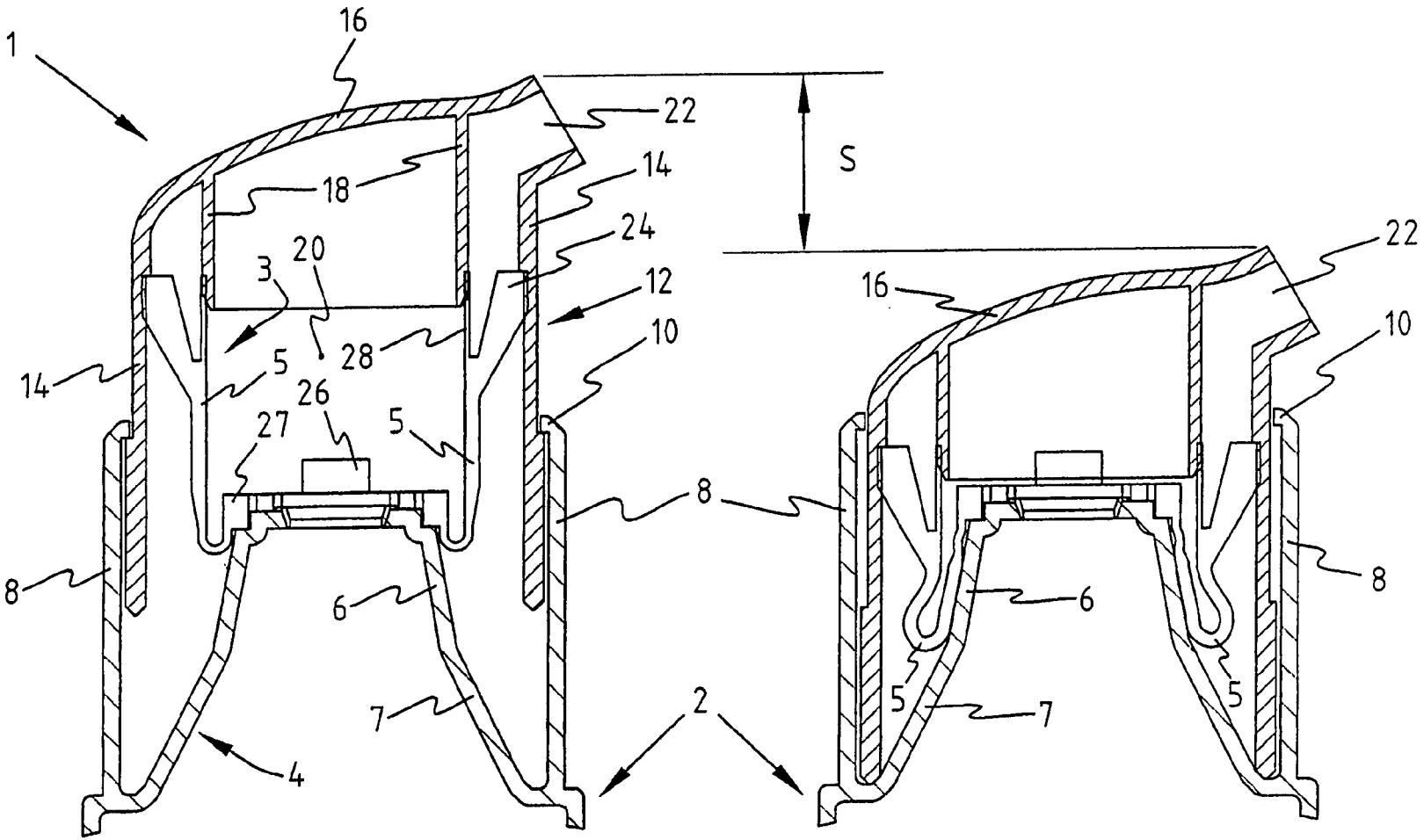

A pump 1, for instance suitable for liquids, pasty material, foam or gases present in a container 2, comprises an assembly of a bellows or bellows part 3 and a co-acting part or unrolling part 4 comprising an outer wall over which a flexible wall 5 of the bellows can unroll (FIGS. 1*a* and 1*b*).

In the shown first preferred embodiment the unrolling part 4, which is for instance point-symmetrical, comprises a first conical part 6 and a second conical part 7 which is connected thereto and has a different angle of inclination and is manufactured integrally with container 2, which further comprises an upright wall 8 with a stop 10 at the top. The wall 8 as shown is cylindrical, although all shapes such as oval or square are possible. The upper part 12 comprises a cylindrical side wall 14 with a thickened portion which rest against stop 10 in a starting position (FIG. 1*a*). The upper part further comprises an upper wall 16 on which the cylindrical wall 18 is arranged on the inside so as to form a chamber 20, and a spout 22 which serves as outflow opening.

Bellows 3 is point-symmetrical and comprises the flexible cylindrical wall 5 with a thickness variation which is such that a desired spring characteristic is obtained, a thickened base 24 which supports against a recess in wall 14 (or for instance against a rib on wall 14), and suction valve 26 which is connected to the turned-back edge 27 and serves to draw in the material from container 2. A relatively thin cylindrical pressure valve 28 rests against the outside of wall 18. The turned-back edge 27 supports on the top of unrolling part 4 in order to absorb pressure force.

A part of flexible wall 5 is turned back for a resilient action. Bellows 3 is manufactured for this purpose from a sufficiently elastically deformable material, such as Skypel®, a thermoplastic polyester, or an elastomer such as silicone rubber. The material of the bellows is preferably a thermoplastic polymer or an elastomer with a low damping so that the material returns more quickly to its original position.

During use of pump 1 a user exerts force on the upper wall 16, wherein the flexible wall 5 unrolls against unrolling part 4 until a second extreme position is reached (FIG. 1*b*). Chamber 20 becomes smaller so that an overpressure is created and valve 28 is pressed outward and the content of chamber 20 flows out of the pump via spout 22.

Figure 1C:
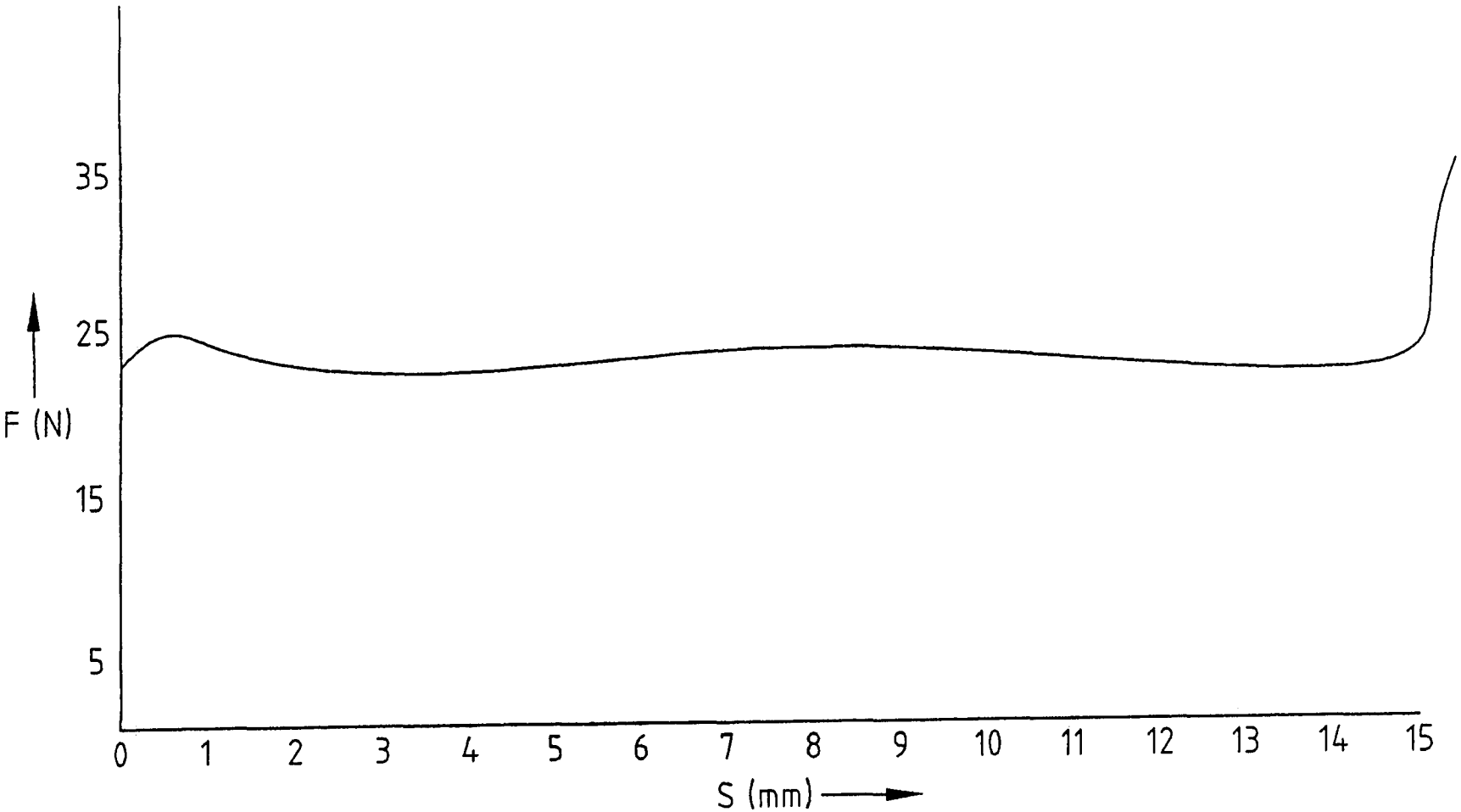

The development of force can be predetermined by the combination of the wall thickness variation of flexible wall 5 and the path of the outer surface of unrolling part 4 against which the wall 5 unrolls. During the unrolling an increasingly large part of the bellows comes into contact with the unrolling part. The force F (y-axis) as a function of the compression S (x-axis) of the pump of FIG. 1*a* is shown in FIG. 1*c*, and the development is roughly level. That is, a user must exert a roughly constant force when pressing upper part 12 downward relative to part 2.

The development of force shown in FIG. 1*c* can be predetermined as desired and depending on the application, so that a constant, increasing or decreasing development, as well as a combination thereof, are among the possibilities. An initially relatively great force followed by a further smaller force, wherein a user has the feeling of tension being released, is also possible. One or more indication peaks or valleys are also possible, wherein the force at a determined compression has a manually discernible differing value, so that a user knows that this particular point has been reached. An indication peak can thus lie for instance at 5 ml, while the end value is 10 ml, whereby dispensing is simpler.

Figures 2A, 2B:
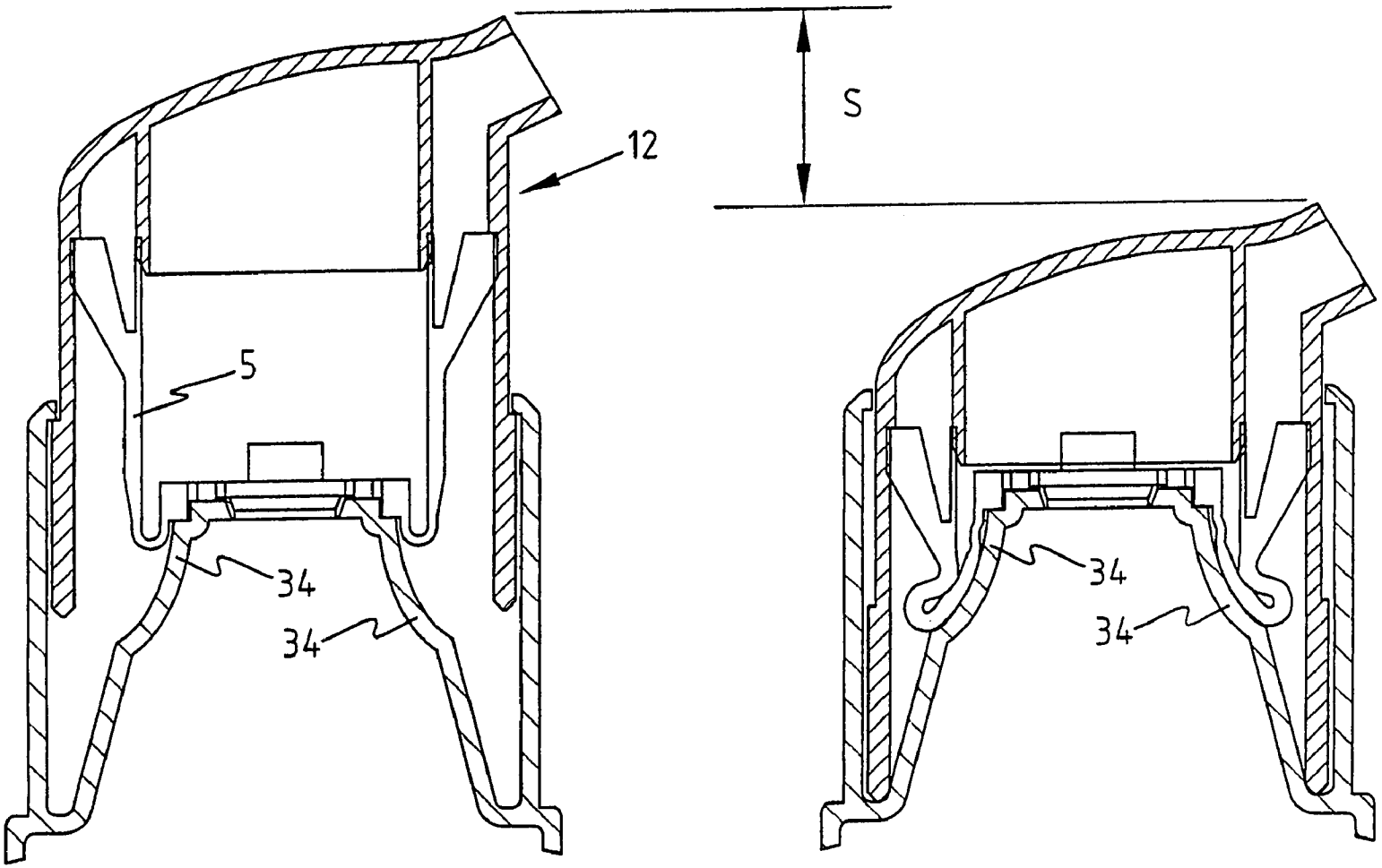
Figure 2C:
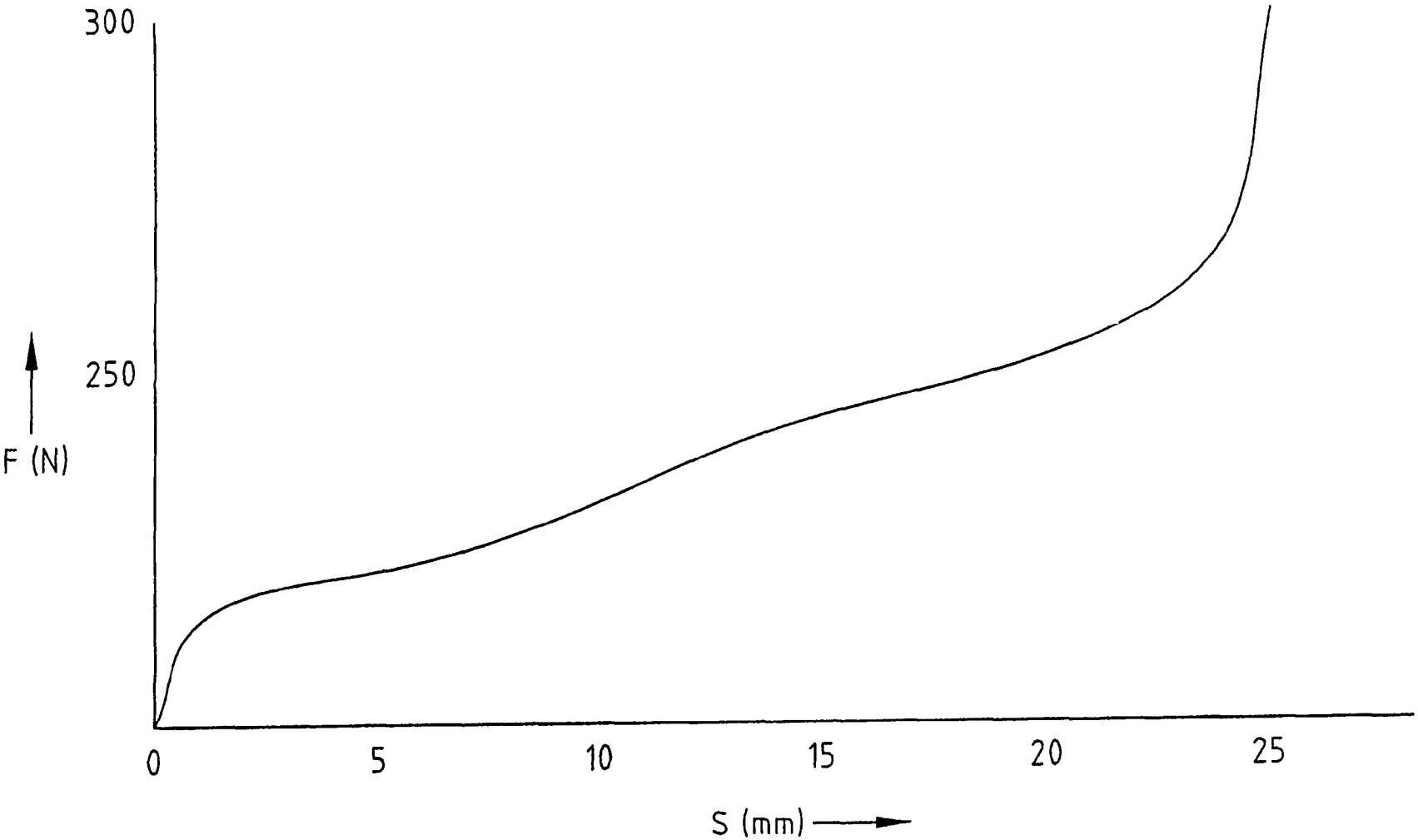

An increasing development of force is for instance obtained by making a first part 34 of the unrolling part concave in cross-section (FIG. 2*a*, 2*b*), wherein the same bellows as shown in FIG. 1*a*, 1*b* is used and the pump further comprises the same components. The curvature of part 34 increases towards the bottom, so that the force required to press upper part 12 downward also increases (FIG. 2*c*).

Figures 3A, 3B:
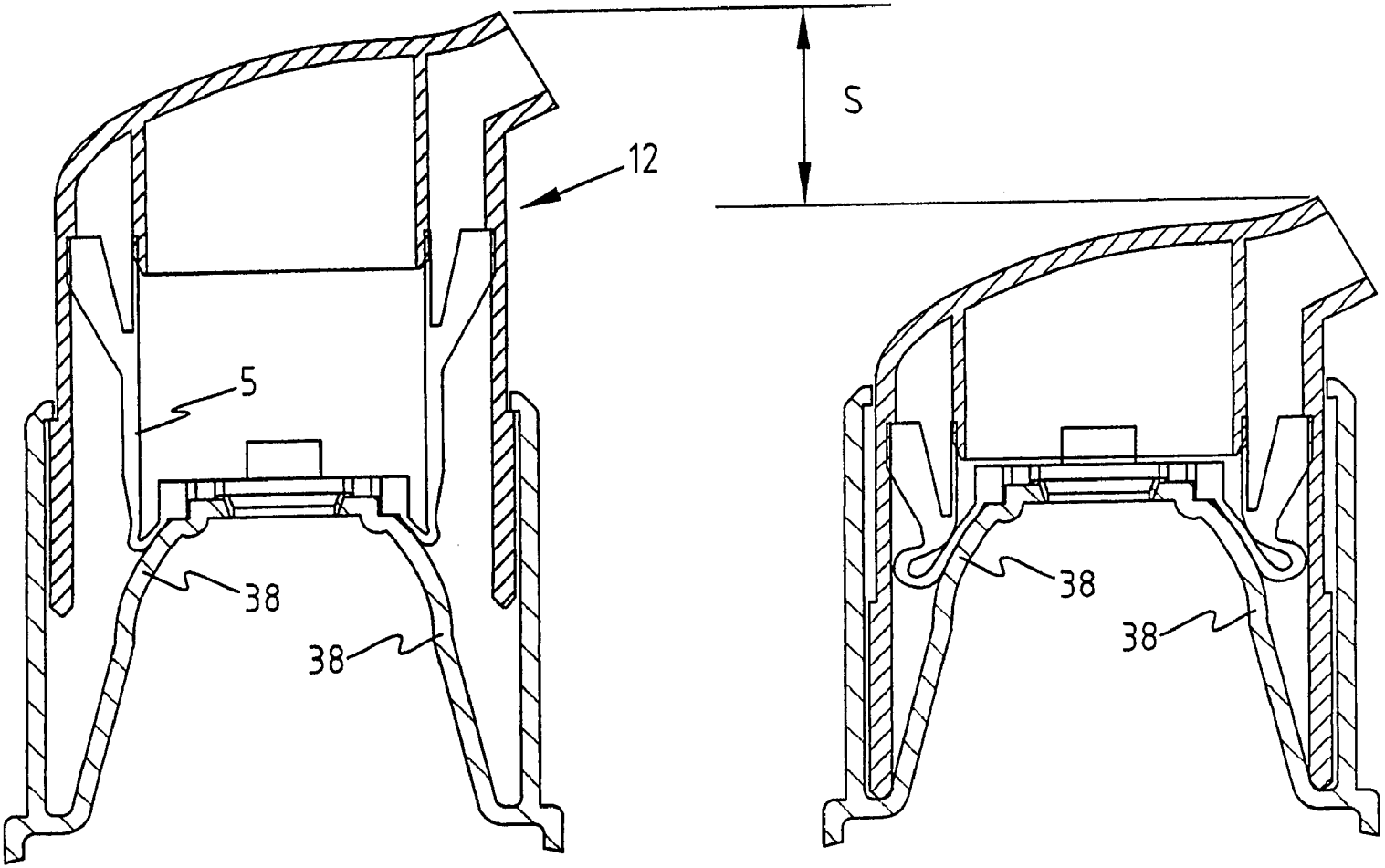
Figure 3C:
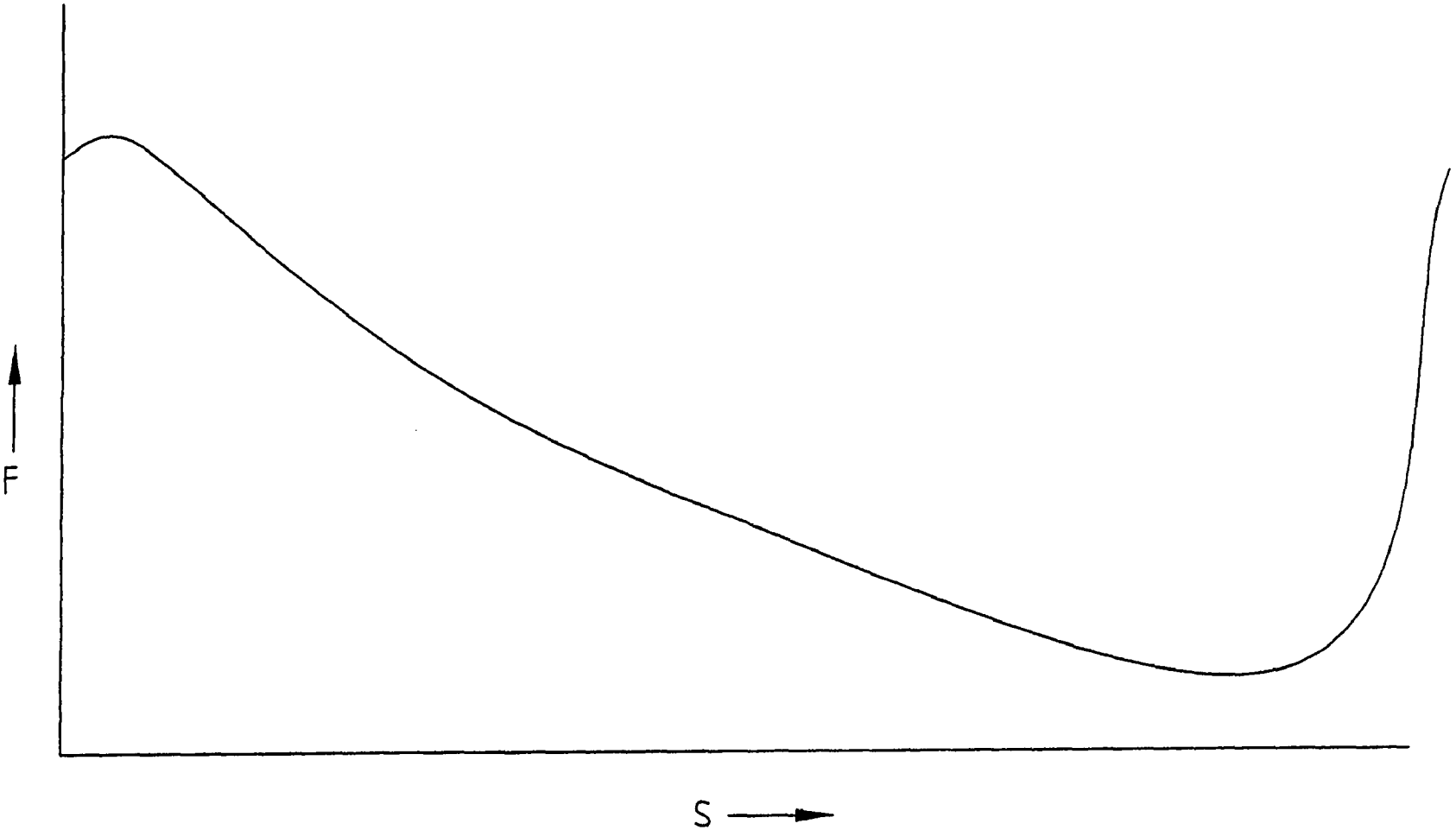

A decreasing force with compression is for instance obtained by making an upper part 38 of the unrolling part convex in cross-section, wherein the angle of inclination is varied for a changing force (FIGS. 3*a*-3*c*).

Figures 4A, 4B:
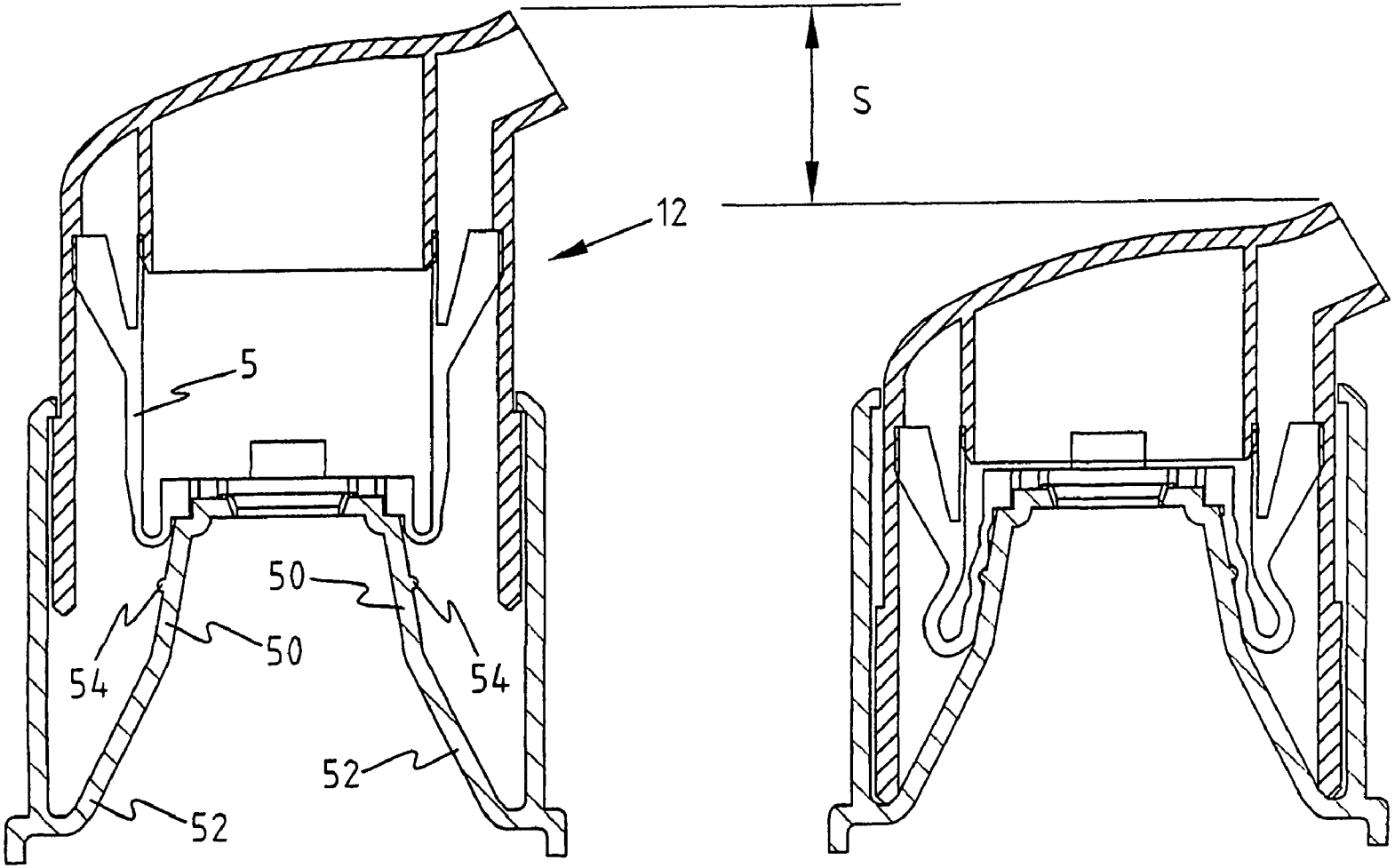
Figure 4C:
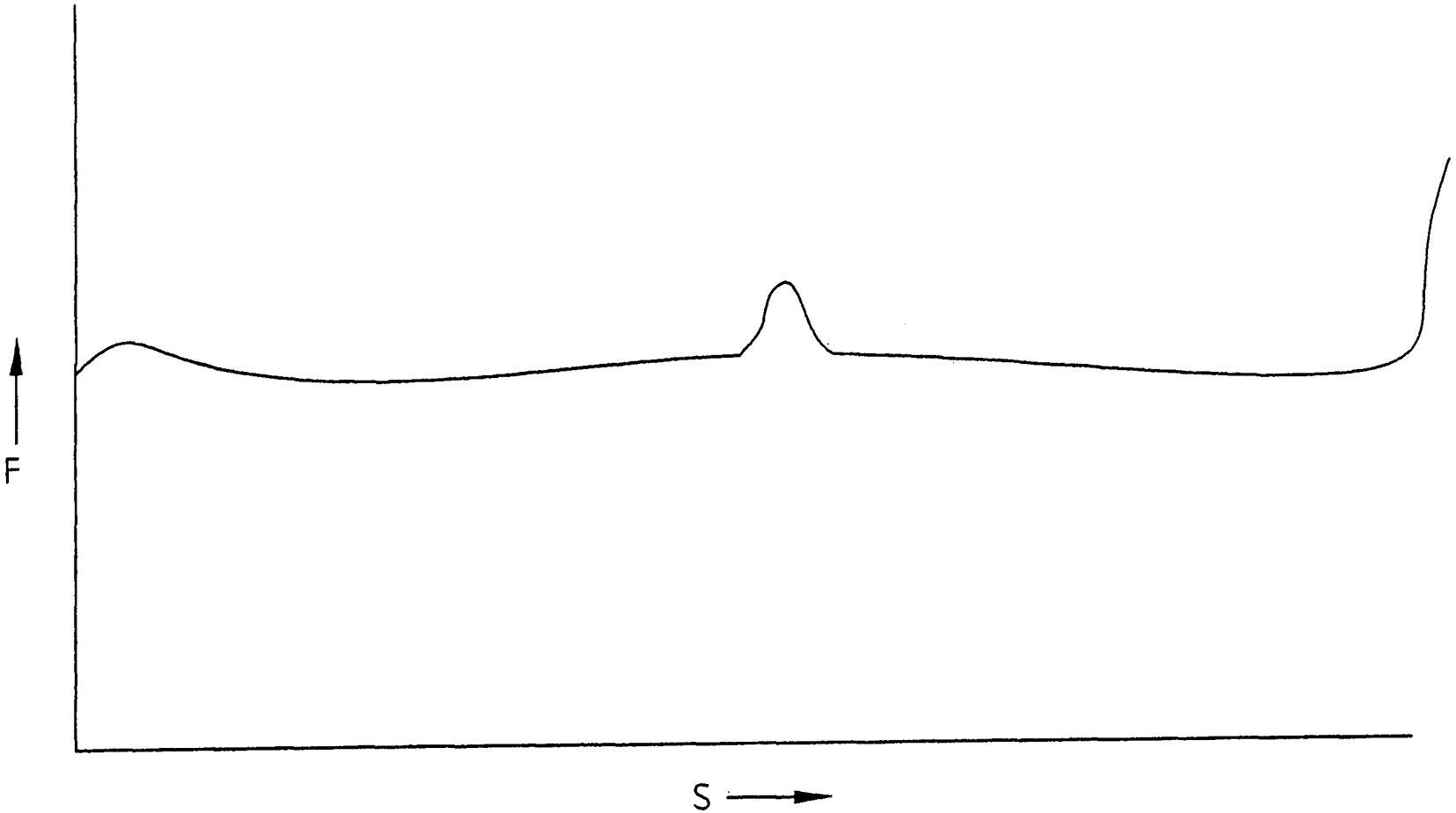

In a fourth preferred embodiment the unrolling part comprises a first conical part 50 and a second conical part 52 with a different angle of inclination. Arranged around the outside of first part 50 is a rib 54 which causes a peak in the force when the flexible wall 5 unrolls thereover (FIGS. 4*a*-4*c*). A plurality of ribs can of course be arranged to cause multiple peaks. In practice the force peaks provide an increase in force of about 10%.

A fifth preferred embodiment (FIG. 5) provides a pump 100 which comprises a container 102 for mounting on a bottle with for instance cleaning liquid, on which a spray nozzle 104 is arranged. The spray nozzle comprises a housing 106 in which is arranged an assembly according to the invention comprising a bellows 108 with flexible wall 110 which cooperates with an unrolling part 112. The assembly can be operated by a pistol mechanism comprising a lever 114 which is coupled via connection 118 to the unrolling part. Parts 116, 120 and 122 serve for venting. The base 124 of the bellows supports against housing 106 on which edge 126 is integrally arranged. In the housing is further arranged an opening 127 and a spray orifice 128 for egress therethrough of the content of container 102.

Figure 5:
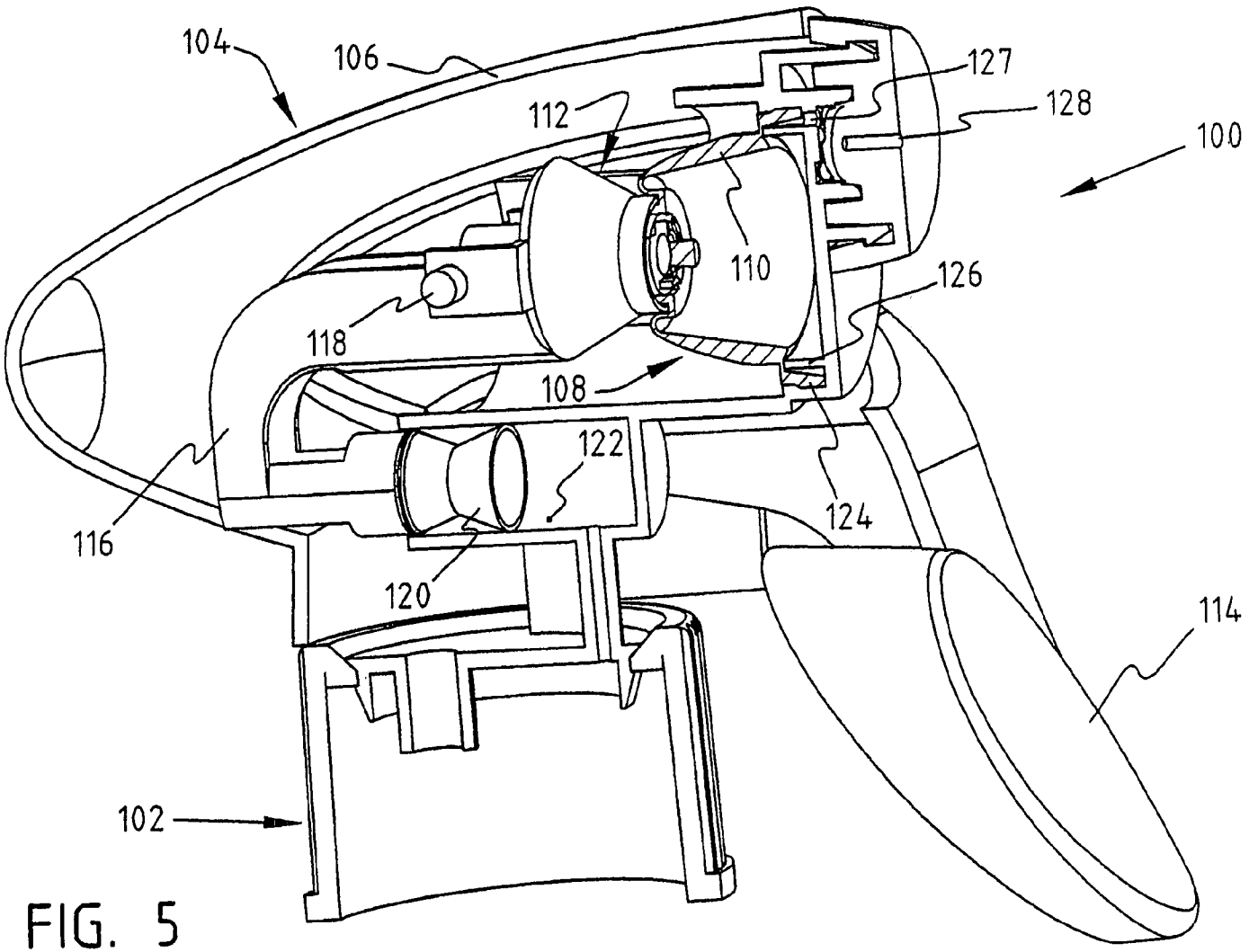
FIG. 5 shows a cross-section in perspective of a pump provided with an assembly according to the present invention in a fifth preferred embodiment.

During use force is exerted on lever 114, whereby unrolling part 112 moves to the right in FIG. 5, wherein the wall 110 unrolls over the unrolling part. When the unrolling part moves to the right pressure is built up inside bellows 108, wherein at a predetermined threshold value the edge 126 no longer seals, so that the content of the bellows is pressed out of the pump via opening 127 and spray orifice 128. Owing to the higher pressure built up in this embodiment and the relatively small diameter of spray orifice 128, the content is atomized as it leaves the spray orifice.

In the shown embodiment (FIG. 5) the unrolling part is movable in the direction of the bellows. It is likewise possible to arrange the bellows such that it is movable in the direction of the unrolling part, i.e. in FIG. 5 the bellows will move to the left when lever 114 is operated.

In practical embodiments the stroke S varies between 10 mm and 25 mm. For a pump to be operated manually as shown in FIG. 1*a*, the maximum force F is about 20 N to 30N, with a minimum value of 5 N for specific applications. Higher pressures are needed to atomize a liquid. The maximum force on the bellows is then about 250 N to 300 N. Manual operation then takes place via a lever mechanism or a pistol mechanism (FIG. 5). The angle of inclination of the unrolling part varies within a range of 0° to 135° so as to obtain the desired development of force. For a low force an angle of inclination of 10° is a practical value.

The bellows of FIGS. 1-4 comprises the thickened conical basis 24 (FIG. 6) which encloses an annular valve 28. An upper side of the base is connected to the cylindrical flexible wall 5. Arranged on the other end thereof is a turned-back edge which is connected to thickened edge 27. The annular, flat upper side of edge 27 serves as support surface for the top side of unrolling part 4. Edge 27 encloses the disc-shaped suction valve 26 which is arranged on edge 27 with three flexible arms 60. Valve 26 comprises a pin-like protrusion 62, for instance for guiding the valve 26.

A practical embodiment of bellows 3 (FIG. 6) has for instance a height of 1 to 5 cm, a cross-section of 1 to 4 cm, a wall thickness of wall 5 of 0.1 to 5 mm, and preferably a wall thickness between 0.2 and 2 mm. Valve 28 has a wall thickness of 0.1 to 0.5 mm, valve 60 has a cross-section of 2 to 10 mm, and base 24 has a thickness in the order of 1 to 15 mm.

Figure 7:
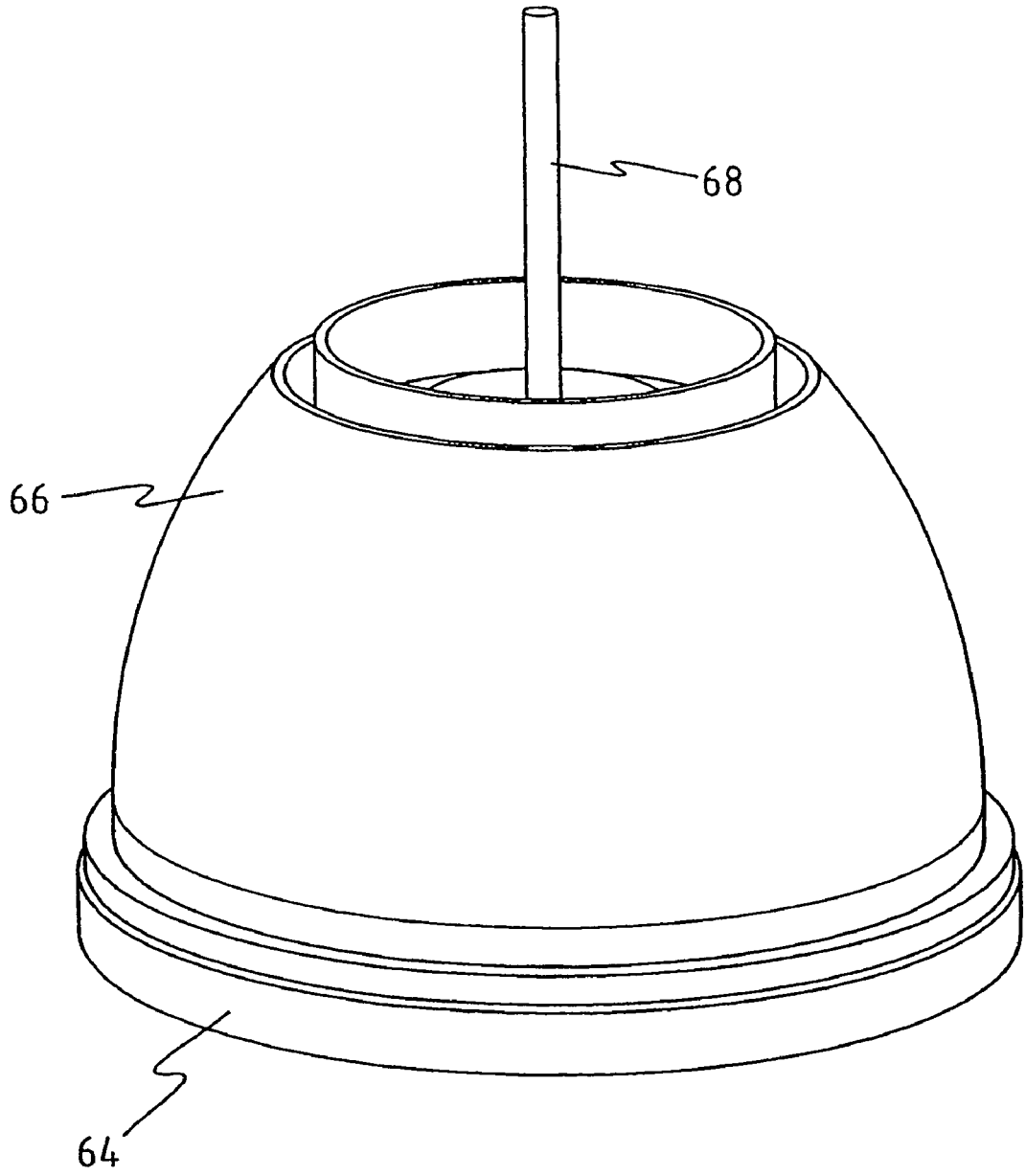
FIG. 7 shows a perspective view of a bellows according to the present invention in a seventh preferred embodiment.

The force with which unrolling takes place can also be determined by adapting the form and the wall thickness of the bellows. In a further preferred embodiment a bellows according to the invention comprises a base 64 on which a flexible wall 66 is arranged, which wall has in cross-section a roughly parabolic progression (FIG. 7), whereby a decreasing force is obtained. For an increasing or decreasing force wall variations are likewise possible in accordance with a function of higher of lower order. Wall 66 is also higher than wall 5, so that it can be unrolled further. The suction valve and the pressure valve are not shown.

Suction valve 36 is arranged on edge 27 with for instance three straight arms 60 (FIG. 8*a*). The whole bellows is of the same material so that the arms are slightly flexible and valve 26 can move. For an improved spring action the valve is arranged on edge 27 via Z-shaped arms 70 (FIG. 8*b*) or arms 72 (FIG. 8*c*). By making the connecting line of the Z longer or shorter, a smaller or greater spring force is obtained and valve 26 can open to a greater or lesser extent, which is important for pasty fluid such as toothpaste.

For a flexible suspension the suction valve 26 can likewise be provided with arms 74 which are C-shaped in side view (FIG. 9) and which otherwise have the same action and function as the Z-shaped arms as described above.

The present invention is not limited to the above described preferred embodiments thereof, in which many modifications can be envisaged; the protection sought is defined on the basis of the appended claims.

The invention claimed is:

1. An assembly, comprising:

a bellows part, comprising:

a flexible wall;

a thickened base at one end of the flexible wall;

a turned-back edge at an opposite end of the flexible wall;

a cylindrical pressure valve adjacent the thickened base at one end of the flexible wall; and a suction valve adjacent to and encircled by the turned-back edge;

a co-acting part, comprising:

a top portion; and a conical outer wall, comprising:

a concave first conical part; and a second conical part;

wherein the turned-back edge of the bellows part rests on the top portion of the co-acting part and the bellows part co-operates with the co-acting part.

2. The assembly of claim 1, wherein a thickness of the flexible wall adjacent the thickened base is greater than the thickness of flexible wall adjacent the turned-back edge so as to cause a desired development of force.

3. The assembly of claim 1, wherein the turned-back edge is arranged on an outer end thereof for the purpose of absorbing a pressure force.

4. The assembly of claim 1, wherein the flexible wall further comprises a thickened portion.

5. The assembly of claim 1, wherein the flexible wall further comprises a bend.

6. The assembly of claim 1, wherein the flexible wall further comprises a concave cross-section.

7. The assembly of claim 1, wherein the flexible wall further comprises a convex cross-section.

8. The assembly of claim 1, wherein the bellows part comprises a material selected from the group consisting of a thermoplastic polymer and an elastomer.

9. The assembly of claim 1, wherein the flexible wall of the bellows part is substantially cylindrical.

10. The assembly of claim 1, wherein the suction valve further comprises three legs connected to the turned-back edge.

11. The assembly of claim 10, wherein the legs are Z-shaped in top view for an improved spring action.

12. The assembly of claim 1, wherein the suction valve further comprises a guide protrusion.

13. The assembly of claim 1, wherein the cylindrical pressure valve comprises a cylindrical flexible wall.

14. A pump, comprising an assembly as recited in claim 1.

15. A method for using an assembly as recited in claim 1, comprising rolling and unrolling the bellows part over at least a portion of the co-acting part.

16. The assembly of claim 1, wherein the turned-back edge further comprises a thickened edge and wherein the thickened edge rests on the top portion of the co-acting part.

17. An assembly, comprising:

a bellows part, comprising:

a flexible wall;

a thickened base at one end of the flexible wall;

a turned-back edge at an opposite end of the flexible wall;

a cylindrical pressure valve adjacent the thickened base at one end of the flexible wall; and a suction valve adjacent to and encircled by the turned-back edge;

a co-acting part, comprising:

a top portion; and a conical outer wall, comprising:

a convex first conical part; and a second conical part;

wherein the turned-back edge of the bellows part rests on the top portion of the co-acting part and the bellows part co-operates with the co-acting part.

18. The assembly of claim 17, wherein a thickness of the flexible wall adjacent the thickened base is greater than the thickness of flexible wall adjacent the turned-back edge so as to cause a desired development of force.

19. The assembly of claim 17, wherein the flexible wall further comprises a thickened portion.

20. The assembly of claim 17, wherein the turned-back edge further comprises a thickened edge and wherein the thickened edge rests on the top portion of the co-acting part.

* * * * *